United States Patent [19]

Bernard et al.

[11] 4,236,125

[45] Nov. 25, 1980

[54] WIDE BAND HIGH POWER VERY HIGH OR ULTRA HIGH FREQUENCY CIRCULATORS

[75] Inventors: Nicolle Bernard; Gerard Forterre, both of Paris, France

[73] Assignee: Societe Lignes Telegraphiques et Telephoniques, Conflans-Sainte-Honorine, France

[21] Appl. No.: 55,766

[22] Filed: Jul. 9, 1979

[30] Foreign Application Priority Data

Oct. 7, 1978 [FR] France ..... 78 20475

[51] Int. Cl.[3] ..... H01P 1/387

[52] U.S. Cl. ..... 333/1.1; 333/246

[58] Field of Search ..... 333/1.1, 24.2

[56] References Cited

U.S. PATENT DOCUMENTS 3,614,675 10/1971 Konishi ..... 333/24.2

*Primary Examiner*—Paul L. Gensler

*Attorney, Agent, or Firm*—Kemon & Eastabrook

[57] ABSTRACT

In a circulator using strip technology a high thermal conductivity through the piled up parts is obtained by use of heat conductive insulating grease layers between the parts which include a solid machined metal cap surrounding the gyromagnetic pellets and broad banding circuits between the ports and earthed contacts on the strip substrate, the capacitor of which uses said cap as an electrode. The outside of said cap is cylindrical, the inside hexagonal.

4 Claims, 10 Drawing Figures

WIDE BAND HIGH POWER VERY HIGH OR ULTRA HIGH FREQUENCY CIRCULATORS

BACKGROUND OF THE INVENTION AND PRIOR ART

The invention concerns lumped impedance broad band circulators intended for operating in the 0.02 to 2 GHz band at a mean power of a number of tens of watts.

Power circulators having electrical characteristics which are as far as possible independent of temperature are required in telecommunications.

It is known that a printed circuit suitable for use at high power can be made by depositing conductors on the two faces of an insulating substrate as described, for example, in U.S. Pat. No. 3,522,555 filed on May 6, 1968, and that in addition line sections can be connected in parallel as described in French Pat. No. 2 202 374 filed on Oct. 5, 1973.

It is known to design a circulator having a broad pass band by surrounding the printed circuit and the associated gyromagnetic pellets by a shielding connected to the casing of the circulator by at least one capacitor as described in U.S. Pat No. 3,818,381 filed on May 21, 1973.

It is known—see the article entitled "Broadband circulators for VHF and UHF", published by G. Schiefer, pages 255 to 263, of No. 9, volume 36 of "Philips Technical Review"—to compensate for the variations of the width of the passband of a circulator as a function of the power of the incident wave by incorporating a matching circuit whose inductance has a negative temperature coefficient in each line section connecting a port to the circuit coupled to the gyromagnetic medium. An inductor of this kind is obtained by winding a number of turns on a toroidal ferrite core of the YIG type, disposed in a continuous transverse magnetic field.

The object of the present invention is to provide a circulator having a broad pass band operating in the very high frequency band, or the ultra high frequency band which has electrical characteristics which are independent of temperature between −40° C. and +80° C. without using a matching inductor having a negative temperature coefficient of the type just mentioned.

SUMMARY OF THE INVENTION

As is well known, lumped constant circulators for very high or ultra high frequencies comprise:

- a double side printed circuit consisting in three transmission line sections which are each connected at a first end to a metal cap connected by a bandpass broadening capacitor to a ring shaped metal casing and three contact plugs with the said casing;
- three first matching circuits which respectively connect the second end of the line sections to the central conductor of each of the three coaxial ports fastened to the casing by means of their outer conductor;
- two pellets of gyromagnetic garnet material which are disposed on either side of the said printed circuit in one of said caps;
- a magnetic circuit which creates a continuous magnetizing field perpendicular to the large faces of the said pellets of which the variation as a function of temperature balances that of the saturation induction of the said pellets;

- a magnetic yoke fastened to said casing and completing the envelope for the circulator.

According to the invention a layer of heat conductive insulating grease is laid between each of the parts piled up to constitute the circulator and the band broadening capacitor consists of the metal cap, a dielectric plate and a steel plate set against the inner wall of a ring casing, layers of said heat conductive grease being provided between the parts constituting said capacitor.

The circulator according to the invention has the following advantages:

- the relative passband covered at the rated power is substantially equal to 66%,
- the insertion loss is lower than 0.6 dB throughout the passband at any temperature in the rated operating range,
- the circulator accepts considerable overloads, for example such as that resulting from a short-circuit of its second port when it is supplied at the rated power applied to its first port, without damage either to itself or to the external circuit;
- the isolation is higher than 17 dB throughout the passband at the rated power;
- the rated temperature range is −40° C. to +80° C.

BRIEF DESCRIPTION OF THE FIGURES

The invention will be readily understood from the following description accompanied by FIGS. 1 to 9 which are given by way of non limiting illustration and in which.

DETAILED DESCRIPTION

Figure 1:
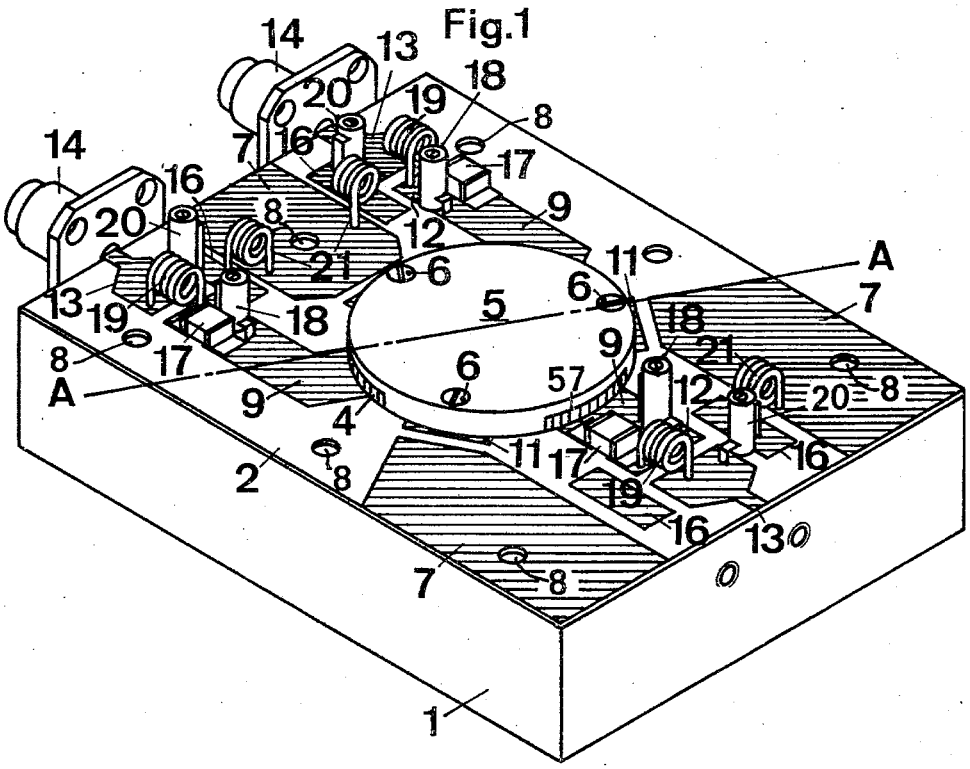
FIG. 1 is a view in perspective of the circulator according to the invention, the upper half of the casing of which has been removed.

FIG. 1 is a view in perspective of the circulator, the upper half of the casing of which has been removed. The lower half-casing 1 carries a printed circuit 2. The upper half-casing 3 (not shown—cf. FIG. 2) is assembled with the half-casing 1 by means of locking screws through the holes 8 for locking the two half-casings against the earth contacts 7. On either side of the printed circuit 2 a pellet 4 of gyromagnetic material, having a resonance line width at most equal to 12 oersteds is located, only one of which is shown in FIG. 1. Each pellet 4 is in contact with a cap 5 machined from a solid and consisting of a metal which is a good conductor both of heat and of electricity, such as brass, and illustrated on a larger scale in FIG. 4. The lateral face of the pellets 4 has three truncations at 120° to one another. The upper face of the printed circuit 2 carries:

the three ground plugs 7 already mentioned, three propagation line sections 9 insulated from the cap 5 by recesses 57 (cf. FIG. 4), three propagation line sections 11 (cf. FIG. 3) situated respectively in prolongation of one of the sections in contact with the cap 5, three propagation line sections 12 and 13 each prolonging sections 9 as far as the coaxial connectors 14 (cf. FIG. 3), four metallized surfaces 16 each serving as an intermediate contact between an earth contact 7 and a metallized surface 13. Each section 12 is connected to each section 9 by a fixed capacitor 17 and by a variable capacitor 18 in parallel with 17. Likewise, each section 12 is connected to a section 13 by a coil 19 having only a few turns. Each assembly consisting of the capacitors 17 and 18 and of coil 19 forms a first matching circuit having a resonance in the passband of the circulator. Each section 13 is connected by a variable capacitor 20 to a metallized surface 16 and each metallized surface 16 is connected to a metallized surface 7 by an inductor 21 having only a few turns. Each assembly consisting of a variable capacitor 20 and an inductor 21 forms a second matching circuit having a resonance in the passband of the circulator.

Figure 2:
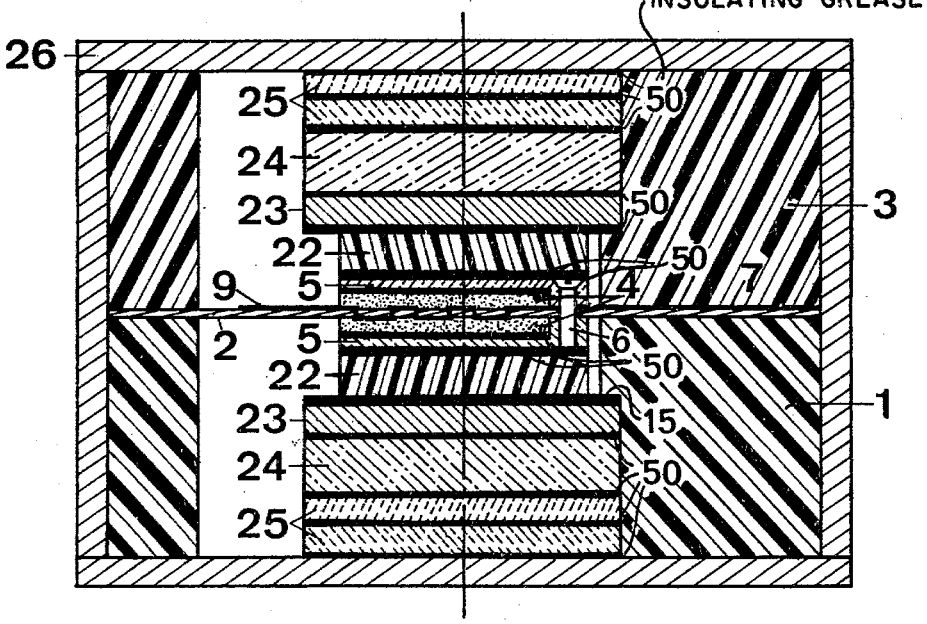
FIG. 2 is a sectional view of the circulator along the line A—A drawn on the preceding figure.

FIG. 2 is a sectional view of the circulator along the line A—A in FIG. 1, in which the thicknesses of the elements have been exaggerated in order to make them more clearly visible. The gyromagnetic pellets 4 are applied against the two faces of the printed circuit 2. A layer 50 of heat conducting insulating grease ensures good thermal contact between each pellet 4 and each cap 5. The grease Elecolit 692 supplied by DINALOY Inc.-HANOVER N.J. is suitable. The outside of each cap 5 carries a dielectric disc 22, a steel disc 23, a magnet 24, a magnetic field corrector 25 and a steel yoke 26 to establish a magnetic field perpendicular to the pellets 4. The thermal contact between the parts which have just been mentioned is obtained by interposing a film of grease, denoted by 50 in FIG. 2, in each instance. The heat generated by the dielectric losses in the pellets 4 passes through the alumina discs 22. Part of the heat is transmitted by the steel discs 23 to the casing by way of the shoulders 15 against which they bear, and the remainder is transmitted by 24 and 25 to the yoke 26 and there through to the casing. The magnetic circuit which builds the continuous magnetizing field is designed so that the field in the gyromagnetic material varies in the same way as the saturation induction as a function of temperature. This compensation is obtained by using magnetic shunts, of which the temperature variation of the magnetization in the neighbourhood of the Curie point is progressive, reversible and rapid. Two different shunts are used, the Curie point of one of which is at 8° C., while the Curie point of the other is at 70° C., so as to obtain a compensation for any temperature between −40° C. and +80° C.

Figure 3:
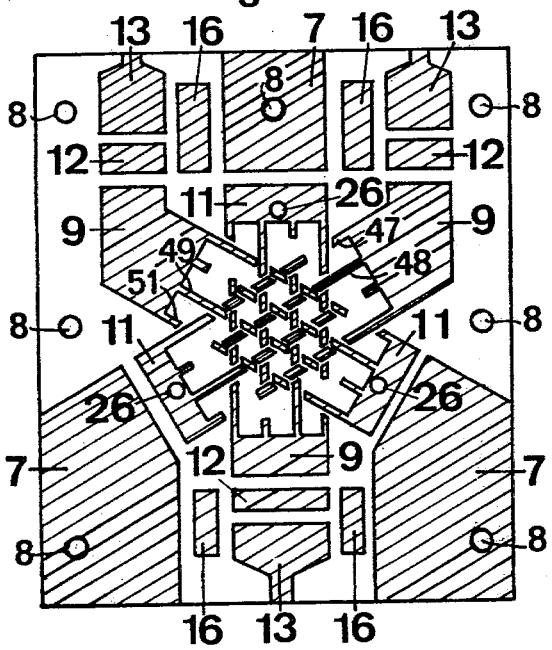
FIG. 3 is a detailed view of the printed circuit, FIGS. 4*a* and 4*b* comprise two sectional views of a part of the circulator.

FIG. 3 is a detailed view of the printed circuit 2 without the added components. The metallized surfaces 7 form the three earth contacts on which the upper half-casing 3 is to bear. The holes 8 are for the connection of the two half-casings 1 and 3. Between the metallized surfaces 7 the three propagation line sections 9 designed 120 degrees apart can be seen. Each section 9 is connected to a section 11 by four narrow conductors 47, 48, 49, 51 which are connected in parallel. These conductors cross one another in passing from one face of substrate 1 to the other through metallized holes. Each section 11 is formed with a hole 26 through which a screw 6 (cf. FIG. 2) passes to connect together the two caps 5 situated on either side of the printed circuit 2. Each section 9 is prolonged by a section 12 which is succeeded by a section 13 connected to the central conductor of a coaxial port.

Figure 4A:
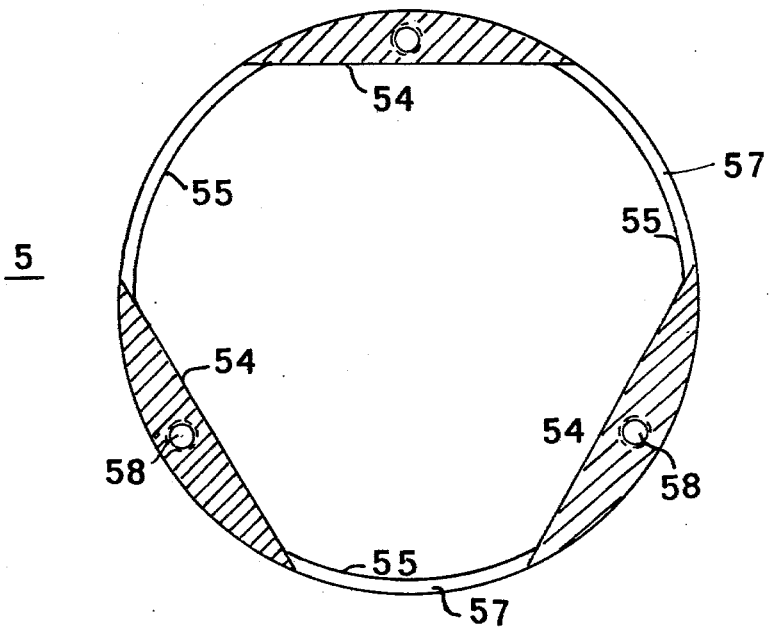
Figure 4B:
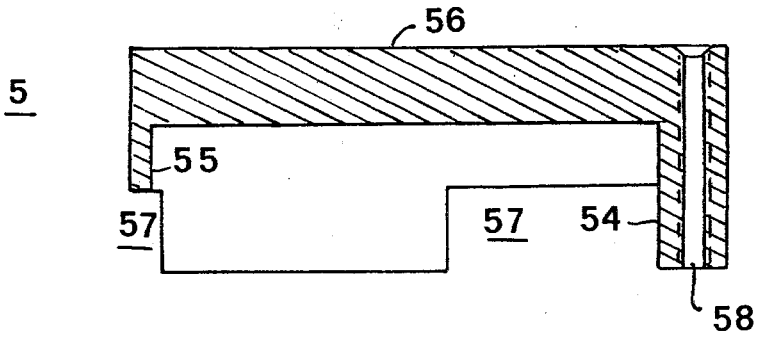

FIGS. 4*a* and 4*b* are large scale sectional views of a cap 5, through the plane of the substrate and through the plane A—A in FIG. 1 respectively. As will be apparent, the cap 5 is a solid member of cylindrical external form, whose internal form is an hexagon having three straight sides 54 and three curvilinear sides 55. The thickness of material between the cylindrical external face and the plane sectional faces 54, as well as that of the base 56, is sufficient to impart considerable rigidity to the member 5. The machining from a solid ensures that the inside surface is of such quality as to permit close contact with the ferrite pellet 4 disposed in the interior and eliminates all danger of a layer of air being inadvertently introduced between the parts. As has been stated, the said pellet is so machined as to reproduce the internal profile of 5. The lateral face of the cap 5 has three recesses 57, the axes of which are the same as those of the plane facets. These recesses are intended to ensure insulation between the conductors 9 and the cap. The cap is formed with tapped holes 58 for the positioning of the fixing screws (cf. 6 in FIG. 2) for the two caps 5 and the printed circuit 2.

The elimination of the layers of air generally present between the gyromagnetic pellet and the shielding affords the following advantages:

precise reproducibility and monitoring of the impedances of the circuit, elimination of the erratic parasitic resonances in the passband, improvement of the thermal conductivity between the pellet and the cap, which can be increased with the aid of a film of heat-conducting grease.

Figure 5:
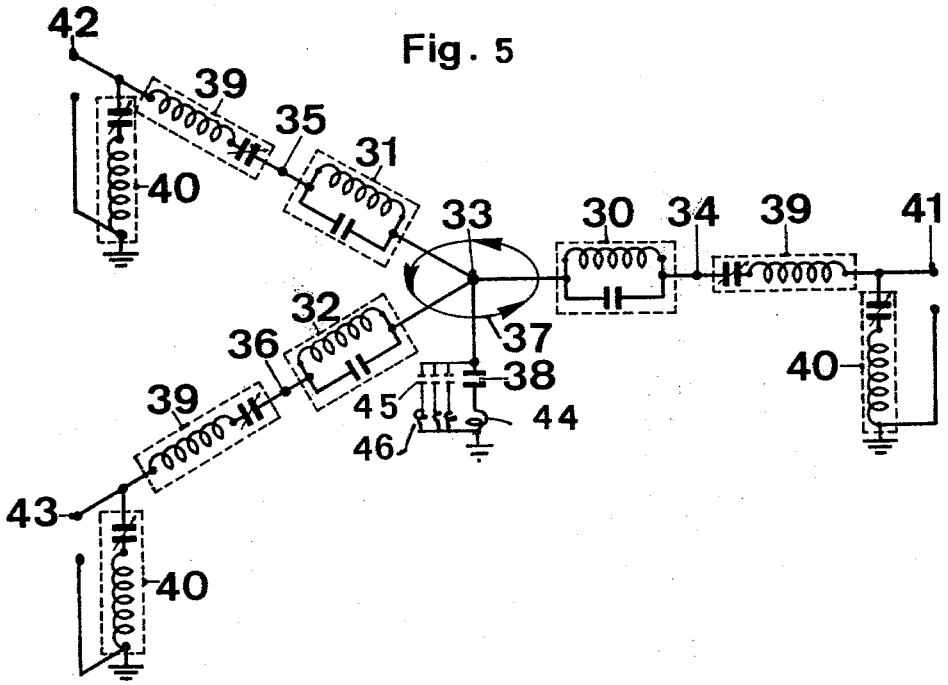
FIG. 5 is the equivalent circuit diagram of the circulator.

FIG. 5 illustrates the network equivalent to the circulator. The line sections 9 imbricated between the pellets 4 of gyromagnetic material and connected to the caps 5 are equivalent to the three parallel resonant circuits 30, 31, 32 disposed between a common point 33 and three terminals 34, 35, 36 and having a circulation effect symbolically indicated by the arrows 37. The two capacitors in parallel, each of which is formed by a dielectric disc 22 between a cap 5 and a disc 23 connected to the wall of the casing, are denoted by 38 and the length of the connections introduces a parasitic inductance 44 in series with 38. In some cases, it may be desirable to dispose between each of the sections 11 and the conductors 7 a bare capacitor 45 in the form of a chip of a value between 0.6 and 4.5 picofarads, of which the position along the gap between 7 and 11 depends upon the inductance value 46 to be provided in order to cover the passband. The advantage of this procedure is that it avoids adjustments of the thickness of the discs 22. The first and second matching circuits are each represented, respectively, by one of the rectangles 39 and 40, the circuits 39 being connected in series between the terminals 34, 35, 36 and the outputs 41, 42, 43 respectively.

Figure 6:
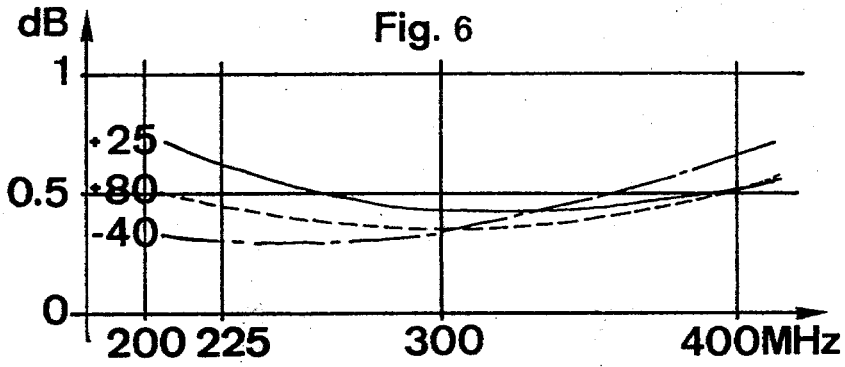
FIG. 6 illustrates the variation of the insertion loss in the passband.
Figure 7:
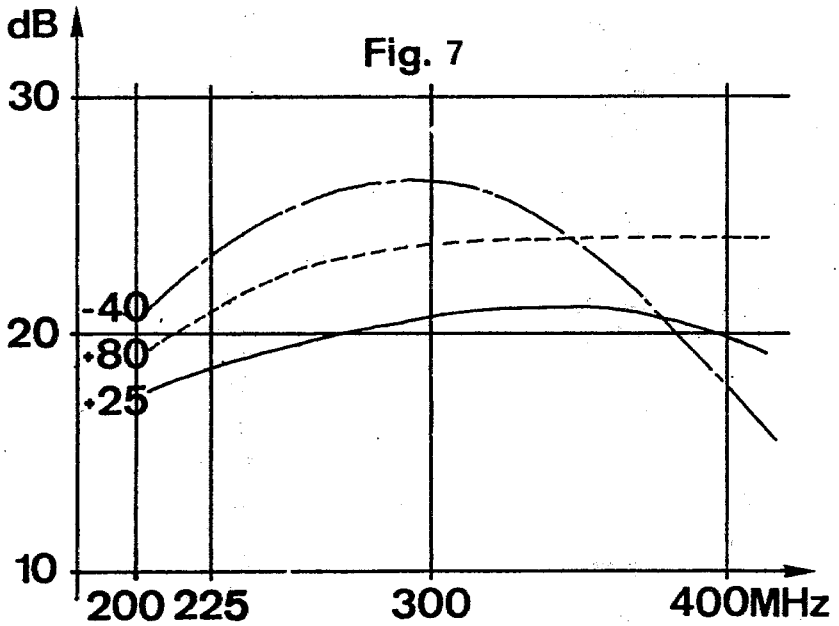
FIG. 7 illustrates the variation of the isolation in the passband.
Figure 8:
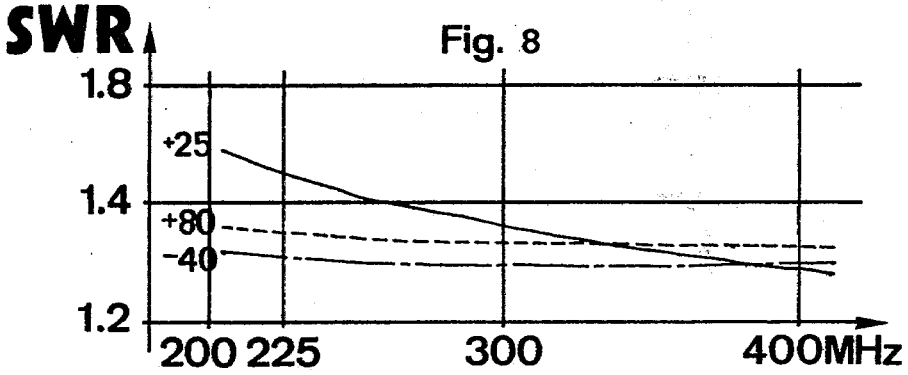
FIG. 8 illustrates the variation of the input standing wave ratio in the passband.

By way of illustration, the Applicants produce a circulator weighing 370 grams, having overall dimensions equal to 64×51×30 millimeters, by means of ferrite pellets marketed by the Applicants under the reference 6391, or again of ferrite Y220 marketed by the company THOMSON-CSF. In these circulators, the discs 22 consist of alumina and their thickness is so adjusted as to give the capacitor 38 a value equal to 60 picofarads. Consequently, the capacitances 45 are dispensed with, since there are unnecessary. The first matching circuits 39 comprise an inductance equal to 20 nanohenrys and a capacitor variable between 12.6 and 18 picofarads. The second matching circuits 40 comprise an inductance equal to 70 nanohenrys and a capacitor adjustable between 0.6 and 6 picofarads. The passband of the circulator covers the range from 225 to 400 MHz when the applied power is at least equal to 50 watts. The insertion loss measured under these conditions remains below 0.6 dB in the temperature range from −40° C. to +80° C. (cf. FIG. 6). The isolation measured in the band at 50 watts level is higher than 17 dB (cf. FIG. 7). The standing wave ratio taken at the input of each port when the succeeding one is matched is lower than 1.45 at any temperature between −40° C. and +80° C. (cf. FIG. 8).

Figure 9:
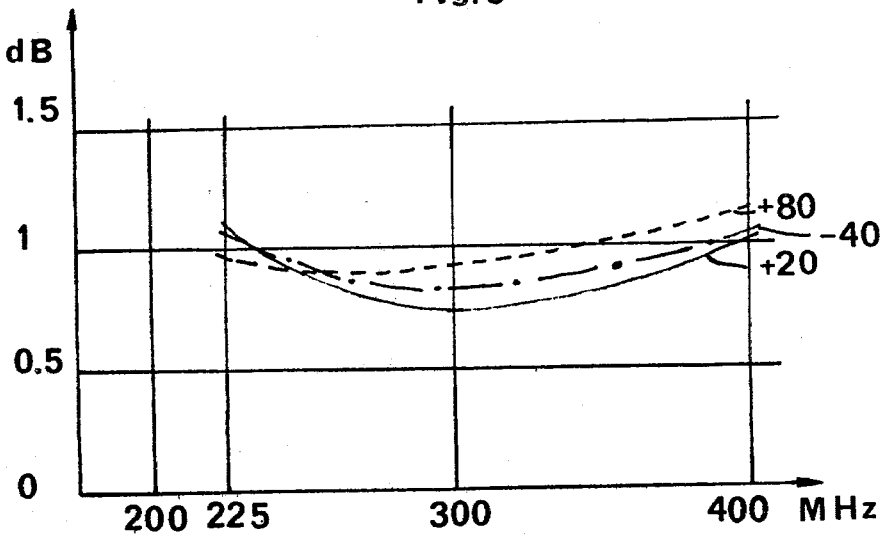
FIG. 9 illustrates the variation of the insertion loss in the passband of the circulator according to the invention when a port is short circuited.

The circulator accepts without damage a power equal to 50 watts at its port 1 regardless of the phase presented by a short-circuit at the terminals of the port 2. FIG. 9 illustrates the insertion loss measured between the port 1 and the port 3 under these conditions. It will be observed that the insertion loss is at most equal to 1.2 dB at any temperature between −40° C. and +80° C.; the peak power at the level of the short-circuit is equal to 200 watts during the measurements.

What we claim:

1. A broad band high power temperature stabilized lumped constant strip line circulator with two band broadening circuits comprising a printed circuit on a substrate and a piling up of parts with intermediate layers of heat conductive insulating grease between successive parts, said parts comprising caps surrounding gyromagnetic pellets made from a solid cylindrical piece of metal the inside of which is machined as an hexagon with three curvilinear sides, said piling up being enclosed in a thick ring shaped casing with internal steps the external bases of which are closed by a magnetic yoke.

2. A broad band high power temperature stabilized lumped constant circulator according to claim 1 in which one of said band broadening circuits includes a capacitor one electrode of which consists of said metal cap, the second electrode is a steel pellet set in place by said casing and the dielectric is a disk set between said electrodes, a layer of said heat conductive grease being provided between said capacitor parts.

3. A broad band high power lumped constant circulator according to claim 2 in which said capacitor capacitance is adjusted by controlling the thickness of said dielectric disk.

4. A broad band high power circulator according to claim 2 in which three small capacitance capacitors are connected in parallel with said band broadening circuit capacitor.

* * * * *